United States Patent [19]

Gatton

[11] Patent Number: 4,762,226

[45] Date of Patent: Aug. 9, 1988

[54] SHIPPING CONTAINER FOR MAJOR APPLIANCES

[75] Inventor: John R. Gatton, Bellville, Ohio

[73] Assignee: White Consolidated Industries, Inc., Cleveland, Ohio

[21] Appl. No.: 541,018

[22] Filed: Oct. 12, 1983

[51] Int. Cl.[4] ..... B65D 15/00

[52] U.S. Cl. ..... 206/320; 206/326; 206/386; 206/598

[58] Field of Search ..... 206/320, 326, 386, 595, 206/597, 598, 600, 453

[56] References Cited

U.S. PATENT DOCUMENTS

| | | | |
|---|---|---|---|
| 2,932,438 | 4/1960 | Smith | 206/320 |
| 2,947,414 | 8/1960 | Johnson | 206/320 |
| 3,335,932 | 8/1967 | Brown | 206/453 |
| 3,666,164 | 5/1972 | Nederveld | 206/320 |
| 3,891,086 | 6/1975 | Isaacs | 206/320 |
| 4,013,168 | 3/1977 | Bamberg et al. | 206/598 |
| 4,042,127 | 8/1977 | Brossia | 206/386 |
| 4,226,327 | 10/1980 | Ballard | 206/320 |
| 4,296,860 | 10/1981 | Hsu et al. | 206/386 |
| 4,392,606 | 7/1983 | Fremion | 206/600 |
| 4,399,915 | 8/1983 | Sorenson | 206/453 |

*Primary Examiner*—David T. Fidei

*Attorney, Agent, or Firm*—Pearne, Gordon, McCoy & Granger

[57] ABSTRACT

A shipping container for a household appliance is formed from a straight tube member of triple wall corrugated fiberboard without any flaps at either the upper or lower ends. A bottom cap formed from single wall corrugated fiberboard has flaps extending upward, overlying and being adhesively secured to the tube member. A top cap, also of single wall corrugated fiberboard, fits over the top of the tube member and on three sides has flap portions similar to those on the bottom cap glued to the outside of the tube member. On the fourth side, the top cap has a triple folded flap portion forming a lifting flange which is held in place by pressure-sensitive tape extending over the flange and onto the sidewalls over both the top cap flap portion and the tube sidewall.

6 Claims, 3 Drawing Sheets

SHIPPING CONTAINER FOR MAJOR APPLIANCES

BACKGROUND OF THE INVENTION

This invention relates generally to shipping containers, and more particularly to shipping containers of corrugated fiberboard for shipping major household appliances such as washing machines, dryers, refrigerators, and food freezers.

Household appliances of these types are generally fairly large and may weigh several hundred pounds, so that the design of shipping containers for these appliances has received considerable attention to provide optimal packaging at minimal expense. Such containers have long been made of corrugated fiberboard in the form of a rectangular prism to allow easy fabrication of the containers as well as the use of automatic machinery to the greatest extent possible to minimize labor costs. Generally, a container comprises a tube portion consisting of four sidewalls which have flap extensions at the top and bottom of each side. The bottom flaps may be secured to a bottom cap, which is glued, stapled, or otherwise secured to the flaps, or the flaps themselves may be made sufficiently large to be folded over and glued or stapled together to form a bottom cap. Likewise, a separate top cap is supplied that is folded over and either glued or stapled, or secured by strapping around the periphery of the upper sidewall portions, to provide complete coverage of the appliance.

The sidewalls of the container must be heavy enough to protect the sidewall portions of the appliance from damage caused by penetration of the sidewalls during handling and shipping, and the containers must be strong enough to allow vertical stacking, often five or more high, to allow efficient usage of floor space in warehouses and in transport vehicles. Heretofore, the stacking and protection requirements have involved the use of corner posts at the four corner portions of the sidewall. These corner posts are generally made by folding several layers of corrugated fiberboard to form a thick, rigid, angular post that fits between the appliance corners and the container sidewalls to support the weight of appliances stacked on top of the particular container, and also to hold the sidewalls a spaced distance away from the walls of the appliance to minimize the effect of any penetration of the sidewalls during handling which might result in contacting and damaging the sidewalls of the appliance. The manufacture and installation of these corner posts have required substantial manual labor, since it is first necessary to place the tube portion of the container over the appliance, after which the corner posts must be carefully and precisely inserted by hand before the final closure can be made.

Another requirement for such containers is that the common method of handling, particularly in warehouses, utilizes a fork lift truck having a lifting member in the form of a horizontally extending, upwardly projecting blade which fits within a reinforced, folded portion of the top cap so that the appliance is lifted from the top without the need to have lifting forks inserted under the bottom, which would require leaving additional vertical spacing for the forks, as well as avoiding the damage caused by the projecting forks as the fork lift vehicle is maneuvered in the warehouse. Thus, in addition to the compressive strength of the tube portion, it is necessary to provide sufficient tensile strength that the appliance can be lifted by the top cap while its weight rests on the bottom cap, without any resulting damage to the appliance.

SUMMARY OF THE INVENTION

The shipping container of the present invention eliminates all corner posts from the tube portion of the container, which consists essentially of three pieces, namely, a tube, a top cap, and a bottom cap, all formed from corrugated fiberboard.

The vertically extending tube portion is formed from a single piece of triple wall corrugated fiberboard folded to provide the four sidewall panels of the container and having a short flap portion folded beneath and glued to the adjacent sidewall to form a rigid square tube. The triple wall corrugated fiberboard is of heavy 600-lb. to 800-lb. stock and is preferably a combination of A-flute, B-flute, and C-flute construction. The tube is dimensioned so that it is a close fit to the walls of the appliance, with the minimum required clearance for easy assembly by slipping it vertically downwardly over the appliance, and the inside wall surface may be coated with a suitable coating material such as polyethylene or a wax to avoid scratching the outer surface of the appliance and to minimize friction therebetween.

The bottom cap consists of a rectangular sheet of single wall corrugated fiberboard having a central panel with outer dimensions equal to the outer dimensions of the tube, and the bottom cap has a flap portion along each edge which is folded upward and glued to the outer surface of the sidewall panels of the tube.

The top cap likewise consists of a single wall corrugated fiberboard material which has a rectangular dimension equal to that of the outer sides of the tube, and along three sides has flap portions similar to those on the bottom cap which are folded over and glued to the outer sides of the tube at the top. The fourth side of the top cap has an elongated, triple folded flap, with the outer portion being of greater width than the two intermediate portions. This flap is folded so that the intermediate portions are folded back into contact with themselves, and the outer portion is then glued to the sidewall of the tube, with the fold being at the top. The intermediate portions are then folded down to provide a lifting pocket or flange for receiving a suitable lifting member of the material handling equipment used for transporting the containers. The flange is held in place, with the intermediate portion adjacent the outer portion, by pieces of filament tape which extend over the outside of the flange around the corners and partially over the adjacent glued flap on the adjacent sidewalls to hold the lifting flange in the proper position.

Because of this construction, in which the heavy triple wall tube sides have sufficient compressive strength to allow stacking of the containers and requiring the use of no corner posts, the assembly of the container is preferably done by first folding the tube portion and then completing the assembly of the top cap in place on the tube portion before the appliance is in place. Then, as the appliance comes off the assembly line, it is placed on top of the bottom cap and the assembled tube and top cap are lowered over the appliance as a unit, after which the flaps on the bottom cap are bent up and glued in place, to complete the assembly of the container and the packaging of the appliance.

DETAILED DESCRIPTION OF THE PREFERRED EMBODIMENTS

Figure 1:
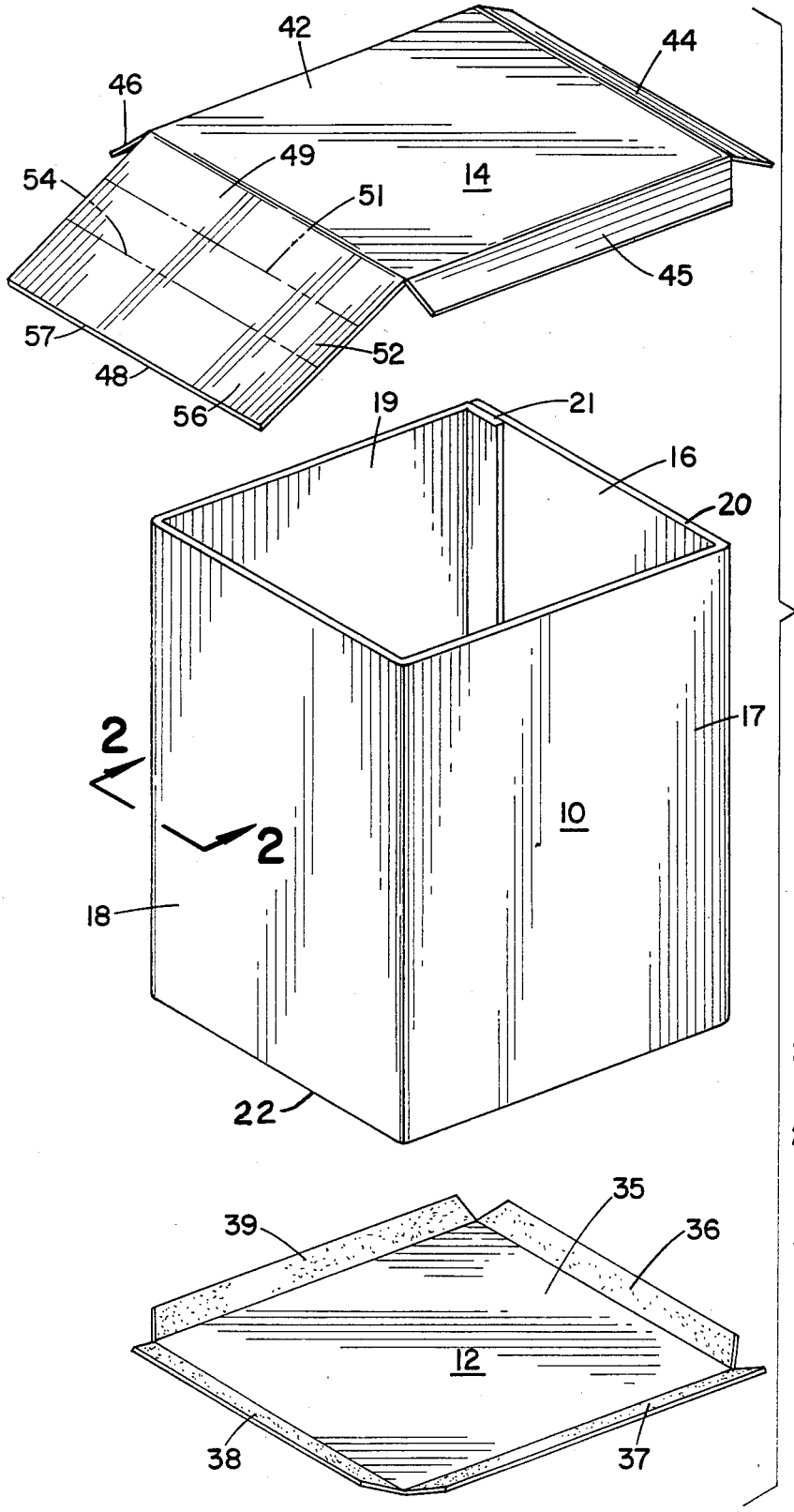
FIG. 1 is an exploded view of the three pieces of the container prior to assembly.

Referring to the figures in greater detail, FIG. 1 shows in exploded position the three-component members of the container according to the preferred embodiment of the present invention. The tube member 10 is in the form of a rectangular, open-ended tube extending the full vertical height of the container, to extend around the sidewalls of the appliance, and the tube 10 is closed off at the bottom by a bottom cap member 12 and at the top by a top cap member 14.

The tube member 10 is formed from a sheet of corrugated fiberboard to form an open-ended rectangular prism having vertically extending, rectangular sidewalls 16, 17, 18, and 19 joined together at corner folds. To close off the tube, a short flap portion 21 extends from the side edge of wall 19 to underlie the edge of wall 16 to which it is glued to hold the tube in the closed position. It should be noted that the tube 10 does not have any flaps formed on it at the top and bottom ends which terminate in cut edges 20 at the top and 22 at the bottom, clearly exposing the corrugations of the fiberboard, which run in a vertical direction.

Figure 2:
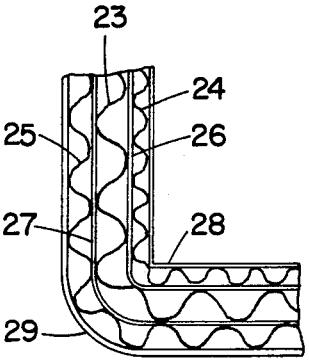
FIG. 2 is an enlarged, fragmentary, cross-sectional view, taken on line 2—2 of FIG. 1, showing the triple wall construction.

As shown in greater detail in FIG. 2, the tube 10 is preferably formed from a triple wall corrugated fiberboard having vertically extending corrugations of different sizes. The center corrugation is preferably of a relatively coarse A-flute 23, while a B-flute layer 24 is on the inside, and a C-flute corrugation 25 is on the outer side, and these are separated from the A-flute by walls 26 and 27, to which the corrugations are glued at contact points. Likewise, the B-flute portion on the inside is covered by an inner wall 28, and an outer wall 29 extends over the outside of the C-flute layer 25. The resulting heavy corrugated fiberboard has a burst strength in the range of 600 to 800 pounds, and preferably the outer wall 29 is thicker than the other walls 26, 27, and 28 for maximum protection against penetration of the tube by exterior objects. The inner wall 28 is preferably covered with a protective low-friction material, such as polyethylene or a suitable wax, to aid in assembly of the carton over the appliance and to avoid scratching of the paint finish of the appliance, as described in greater detail hereinafter.

The use of the triple wall corrugated fiberboard gives a tube of great vertical crush strength, and eliminates any need for corner posts between the carton tube and the appliance. For this reason, the tube 10 can be sized with a minimum clearance between the inner wall 28 and the exterior of the appliance, and this clearance may be one-quarter inch, or even as low as zero. Thus, even though the triple wall corrugated fiberboard is quite thick, the overall outer dimensions of the outer wall 29 tend to be smaller than when a thinner corrugated fiberboard is used in conjunction with the corner posts, and because of the close spacing of the tube from the appliance, as well as the fact that it is of heavy wall construction throughout its entire extent, the resulting container can allow stacking as much as five or more high in warehouse storage situations without any crushing or collapse of the containers.

At its bottom end, the tube 10 is closed off by bottom cap 12, which may be formed from a relatively lighter, single wall corrugated fiberboard having a burst strength of, for example, 275 pounds. The bottom cap 12 has a central panel 35 having dimensions substantially equal to that of the tube bottom edge 22 at the outer wall 29. The bottom cap 12 has four flaps 36, 37, 38 and 39 extending from the edges of the central panel 35 along folds arranged to fold upward into abutting contact with the bottom portion of the walls 16, 17, 18, and 19 and be secured thereto. For maximum strength of the container, it is preferred to use a high strength, quick-setting adhesive or glue which is coated on the flaps 36–39, although the adhesive could also be placed on the bottom portion of the tube walls 16–19, depending upon the exact nature of the assembly operation, which will be described in greater detail hereinafter. It will be noted that the bottom cap 12 can be made of substantially thinner material then that of the tube 10, since the tube 10 fits close to the outer peripheral walls of the appliance, which is preferably mounted on a wooden skid, which in turn rests on the center panel 35. Because of the close fit of the inner wall 28 of the tube 10, the weight of the appliance is supported on the center panel 35 very close to the tube 10, and hence close to the flaps 36–39, so there is little tendency of the appliance to puncture the bottom cap 12.

In similar manner, the top cap 14 may also be formed from a single wall corrugated fiberboard of 275 pounds burst strength. The top cap 14 includes a center panel 42 having a peripheral size equal to that of the top edge 20 of the tube 10 at the outer wall 29. On three sides adjacent the tube walls 16, 17, and 19, the top cap 14 has flaps 44, 45, and 46 which are folded downward and secured, preferably by gluing, to the top portions of walls 16, 17, and 19 in the same manner as with the flaps on the bottom cap 12. It should be noted that, while the direction of corrugation is not critical with the bottom cap 12, it is important with the top cap 10 that the corrugation lines run parallel to the flaps 45 and 46 because of the construction of the fourth flap.

On the side adjacent one of the tube sides, such as side 18, the top cap member 14 is provided with an elongated flap 48 which is preferably about 4½ times longer than the flaps on the other three sides of the top cap 14. The flap 48 has an inner portion or panel 49 adjacent the center panel 42 which is joined along a fold line 51 to a middle or intermediate portion or panel 52. The intermediate panel 52 is, in turn, joined along another fold 54 to an outer panel portion 56 which terminates at an edge 57 and is preferably about twice as long as any of the other flap or flap portions of the top cap member 14.

The purpose of the construction of the flap 48 is to provide a flange or pocket for engagement with a lifting member as is customary with modern handling methods for household appliances. When the top cap 14 is applied to the tube 10, as previoiusly stated, the flaps 44, 45, and 46 are glued down to the adjacent sidewalls in a manner similar to the flaps on the bottom member 12.

However, the flap member 48 is first folded inwardly along fold line 51 and outwardly along fold line 54 to bring the fold line 54 up adjacent the center panel 42. With this fold, the outer panel portion 56 is then glued directly to the tube wall 18 so that the fold 54 is adjacent the top edge 20 of the tube 10. This leaves the inner and intermediate panels 49 and 52 folded along the line 51 back on themselves by the 180-degree fold at the fold line 51 to provide a projecting flange which is slightly longer than the flaps 44, 45, or 46.

To hold this flange in the down position, it is necessary to fold it down so that the middle panel 52 lies adjacent the outer panel 56, and tape members 58 are applied to each side of the flange. The tape members 58 are pieces of filament-reinforced, pressure-sensitive tape having a very high tensile strength, and are attached in order to hold the flange in the folded position adjacent the outer panel 56. Thus, the tape 58 has a portion 59 extending over the outer surface of the inner flap portion 49, and since the flap portion 49 is longer than the other top member flap portions 44, 45, and 46, the bottom edge 62 of the tape member 58 may lie a spaced distance above the fold 51. The tape member 58 also has a second portion 61 extending over the adjacent flap, such as flap 45, on the adjacent sidewall, and the tape 58 is so positioned that the bottom edge 62 extends below the edge of the flap 45 and has a portion contacting the sidewall 17 directly. Since the tape is of uniform length, the portion along the bottom edge 62 of the tape is in greater tension than the remainder of the tape, and this prevents curling of the tape when tension is applied when the container is lifted by the flange.

Figure 5:
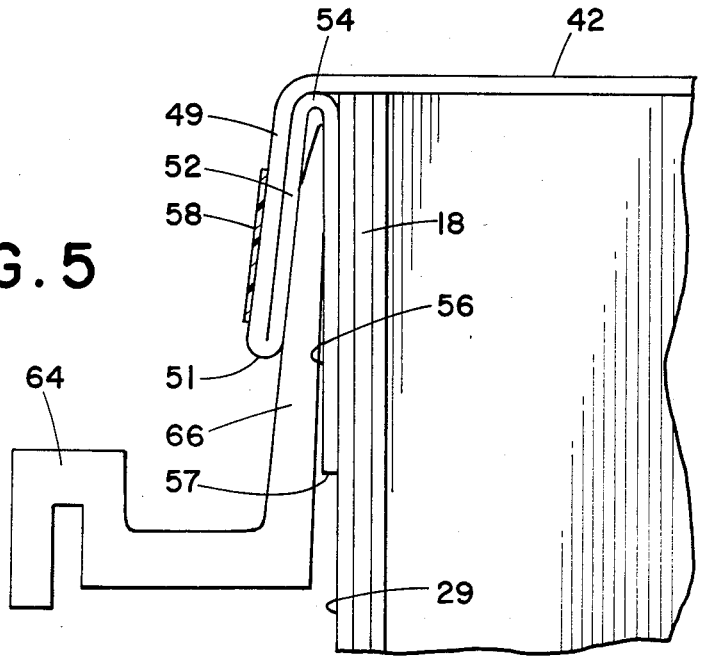
FIG. 5 is a fragmentary, cross-sectional view, taken on line 5—5, showing a lifting member in engagement with the lifting flange.

As shown in FIG. 5, a conventional lifting member 64 having a blade 66, as is commonly used on lift trucks for handling household appliances, is so arranged that the blade portion 66 can fit up within the pocket formed between the intermediate panel 52 and the outer panel 56. Because of the presence of the tape 58, the flap is held tightly against the outer surface of the container, and the force applied to the blade 66 is therefore able to lift the container with the enclosed appliance without any damage to the lifting flap or the rest of the container.

Figure 3:
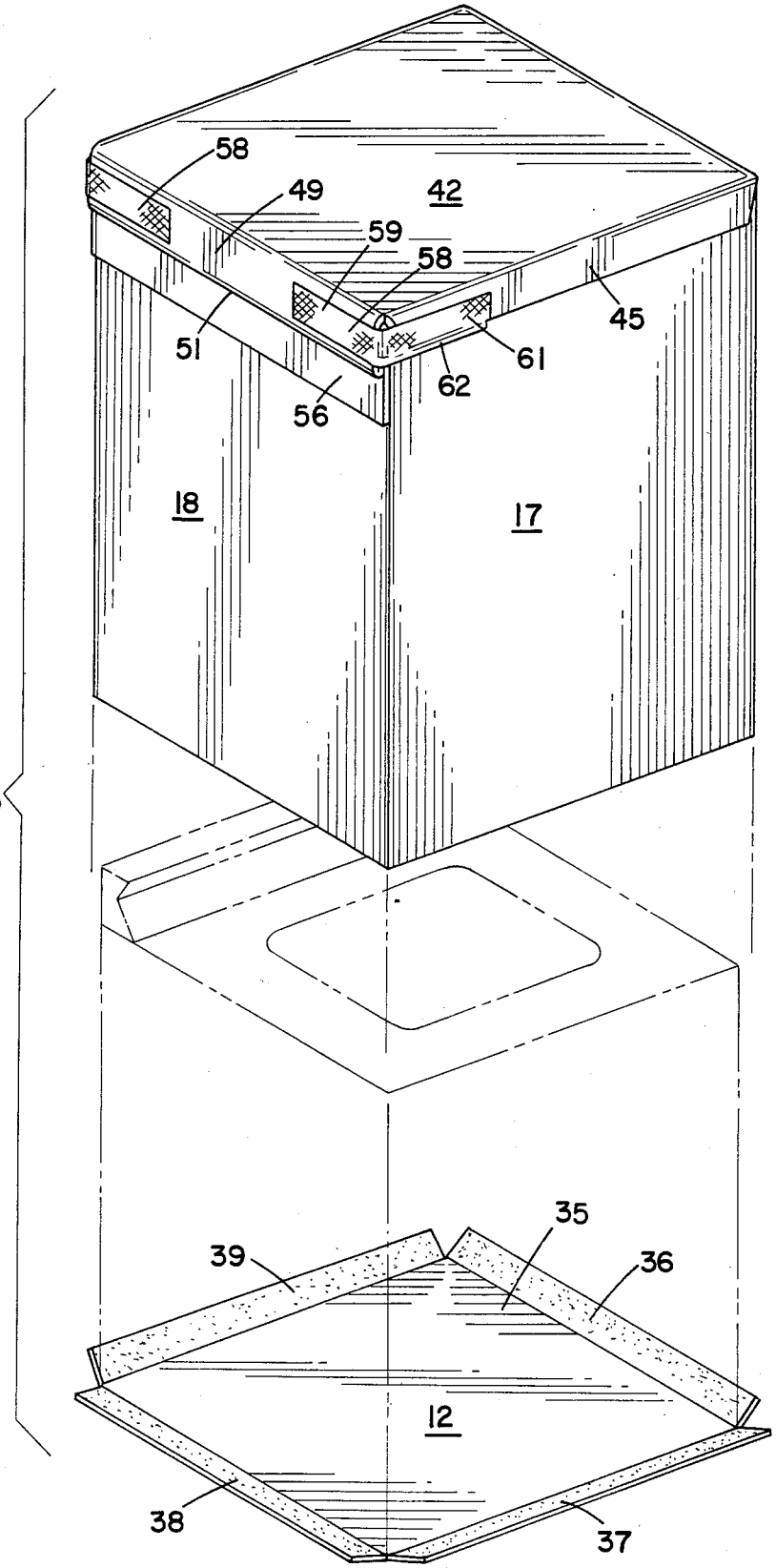
FIG. 3 is an exploded view, with an appliance shown in phantom, showing the top cap assembled to the tube and the method of assembly.
Figure 4:
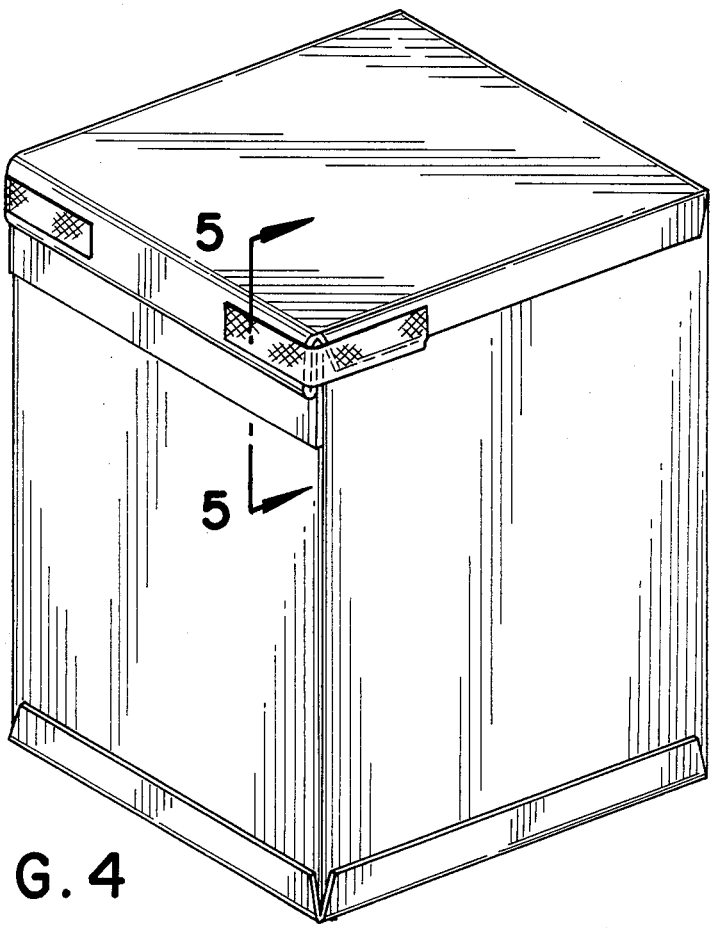
FIG. 4 is a perspective view of the completed container assembly.

The carton of this invention not only is of simpler construction, while retaining high strength, but also allows considerable labor saving in the assembly of the carton on the appliance. With conventional packaging systems, the appliance is placed on a bottom panel, after which a tube is placed around the appliance and suitable corner posts inserted by hand between the tube and the appliance, following which the top cap is applied and held in place, usually by banding with high tensile strength strapping material. However, with the present invention, it is preferred that the top cap 14 first be preassembled to the tube 10 and be glued in place and have the tape members 58 applied. The appliance is then placed on the bottom cap member 10 in the proper position and the assembled tube 10 and top cap 14 placed thereover, as shown in FIG. 3, which can easily be done because there are no corner posts in place. After the tube member and top caps are placed over the appliance, it is only necessary to bend up the flaps on the bottom cap 12 and glue them in place as described, and the appliance is then ready for shipment.

Although the preferred embodiments of this invention have been shown and described, it should be understood that various modifications and rearrangements of the parts may be resorted to without departing from the scope of the invention as disclosed and claimed herein.

What is claimed is:

1. A shipping container for a household appliance comprising a tube member folded from a sheet of corrugated fiberboard to form four vertically extending sidewall panels, and a top cap of corrugated fiberboard extending horizontally over the upper end of said tube member, said top cap having a folded flap portion along three sidewall panels extending downwardly in surface-abutting contact with the outer surface of the adjacent sidewall panel and adhesively secured thereto, said top cap on said fourth side having an integral triple folded flap, the outer panel of said flap being secured in abutting relationship to the adjacent sidewall panel of said tube with the flap fold adjacent the top edge of the panel, the intermediate flap folds extending downward and defining a lifting flange, and adhesive tape material at each side of said flange extending over the outer surface of said lifting flange horizontally to and over the adjacent top cap flap to hold said lifting flange adjacent said outer flap panel, said tape material at its lower edge also being in adhesive engagement with the adjacent tube panel below said top cap flap portion.

2. A shipping container as set forth in claim 1, wherein said tube member is triple wall corrugated fiberboard.

3. A shipping container for a household appliance comprising a tube member folded from a sheet of corrugated fiberboard to form four vertically extending sidewall panels, said panels terminating at the upper and lower ends in horizontally exposed cut ends, a bottom cap of corrugated fiberboard extending horizontally over the lower end of said tube member, said bottom cap having a folded flap portion along each sidewall panel extending upwards in surface-abutting contact with the outer surface of the adjacent sidewall panel and adhesively secured thereto, a top cap of corrugated fiberboard extending horizontally over the upper end of said tube member, said top cap having a folded flap portion along three sidewall panels extending downwardly in surface-abutting contact with the outer surface of the adjacent sidewall panel and adhesively secured thereto, said top cap on said fourth side having an integral triple folded flap, the outer panel of said flap being secured in abutting relationship to the adjacent sidewall panel of said tube with the flap fold adjacent the top edge of the panel, the intermediate flap folds extending downward and defining a lifting flange, and adhesive tape material at each side of said flange extending over the outer surface of said lifting flange horizontally to and over the adjacent top cap flap to hold said lifting flange adjacent said outer flap panel, said adhesive tape material at its lower edge also being in adhesive engagement with the adjacent tube panel below said top cap flap portion.

4. A shipping container as set forth in claim 3, wherein said tube member is formed from triple wall corrugated fiberboard.

5. A shipping container as set forth in claim 4, wherein said bottom cap is single wall corrugated fiberboard.

6. A shipping container as set forth in claim 5, wherein said top cap is single wall corrugated fiberboard.

* * * * *